US007044744B2

(12) United States Patent
Sellien

(10) Patent No.: US 7,044,744 B2
(45) Date of Patent: May 16, 2006

(54) ELECTRICAL VEHICLE DOOR HANDLE PLUG CONNECTION SYSTEM

(75) Inventor: Kai Sellien, Lampertheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/911,139

(22) Filed: Aug. 4, 2004

(65) Prior Publication Data

US 2005/0059267 A1 Mar. 17, 2005

(30) Foreign Application Priority Data

Aug. 12, 2003 (DE) ..... 103 37 055

(51) Int. Cl.
*H01R 33/00* (2006.01)

(52) U.S. Cl. ..... 439/34

(58) Field of Classification Search ..... 439/34, 439/342, 343, 247, 248, 352, 188; 340/4.26, 340/5.72; 240/2.13
See application file for complete search history.

(56) References Cited

U.S. PATENT DOCUMENTS 5,248,259 A * 9/1993 Naito et al. ..... 439/34
5,788,522 A * 8/1998 Kameyama ..... 439/248
6,159,030 A * 12/2000 Gawron et al. ..... 439/247
6,565,142 B1 * 5/2003 Gibney et al. ..... 296/146.7
6,602,077 B1 * 8/2003 Kasper et al. ..... 439/34
6,698,140 B1 * 3/2004 Tatsumi et al. ..... 49/502
2003/0001729 A1 * 1/2003 Ieda et al. ..... 340/426

FOREIGN PATENT DOCUMENTS

DE 102 35 583 A 1 2/2003

* cited by examiner

*Primary Examiner*—Alexander Gilman
(74) *Attorney, Agent, or Firm*—Barley Synder LLC

(57) ABSTRACT

An electrical plug connection system includes a vehicle door handle having a plug connection member. A bearing shell for positioning in a vehicle door has a passageway and an opening. The opening communicates with the passageway and receives the plug connection member. A holder is arranged in the bearing shell to the opening. A plug connector is attached to the holder in a pre-assembly position. The plug connector is releasable from the holder when the plug connection member engages the plug connector. The plug connector is pivotable into the passageway by the plug connection member after the plug connector is released to a final position.

16 Claims, 11 Drawing Sheets

ELECTRICAL VEHICLE DOOR HANDLE PLUG CONNECTION SYSTEM

FIELD OF THE INVENTION

The invention relates to an electrical plug connection system for a vehicle door and to a method for mounting the same.

BACKGROUND OF THE INVENTION

In the field of motor vehicles, particularly cars, conventional keys for locking and unlocking a door lock are being replaced with remote control systems. In the remote control system, the door is locked and unlocked by a transmitting/receiving system using electromagnetic radiation. For example, the remote control system can include a transmitter constructed similar to a key that has an actuation button that actuates the door lock to lock or unlock the vehicle door. In another example, the remote control system is similar to a transponder in that a door locking system equipped with electronic components cooperates with an authorization card having an electronically stored authorization code. When the authorization card is within a given distance of the vehicle door, the authorization code is read off automatically to lock or unlock the door lock. Because the authorization code can be transmitted while the authorization card is in a user's wallet or in a user's clothing pocket, the door lock can be locked or unlocked without the user having to hold the authorization card in their hand and put it close to the door lock.

The electronic components which are required on the vehicle for these remote control systems are accommodated in a door handle on the vehicle door. The electronic components have to be electrically connected to electronic components, for example, actuators for locking and unlocking the door lock, located within the door-mounted equipment of the door and provided with the door lock. Because the vehicle doors are typically mounted from the inside, the electronic components located in the door-mounted equipment are not accessible when the door handle is mounted. It would therefore be desirable to develop a plug connection system such that when the door handle is mounted, an electrical connection can still be made between the electronic components located in the door handle and the electronic components accommodated in the door-mounted equipment when the electronic components in the door mounted equipment are no longer directly accessible.

SUMMARY OF THE INVENTION

The invention relates to an electrical plug connection system. The system includes a vehicle door handle having a plug connection member. A bearing shell for positioning in a vehicle door has a passageway and an opening. The opening communicates with the passageway and receives the plug connection member. A holder is arranged in the bearing shell to the opening. A plug connector is attached to the holder in a pre-assembly position. The plug connector is releasable from the holder when the plug connection member engages the plug connector. The plug connector is pivotable into the passageway by the plug connection member after the plug connector is released to a final position.

The invention further relates to an electrical plug connection system. The system includes a vehicle door handle having a plug connection member. A bearing shell for positioning in a vehicle door has a passageway and an opening. The opening communicates with the passageway and receives the plug connection member. A holder is arranged in the bearing shell adjacent to the opening. A plug connector has a connector position assurance slide member that secures the plug connector to the holder in a pre-assembly position. The plug connection member has an ejector projection that engages the connector position assurance slide member to release the plug connector from the holder. The plug connector is pivotable into the passageway by the plug connection member after the plug connector is released to a final position.

The invention still further relates to an electrical plug connection system. The system includes a bearing shell for positioning in a vehicle door having a passageway and an opening that communicates with the passageway. A holder arranged in the bearing shell adjacent to the opening. A plug connector has a connector position assurance slide member that releasably attaches the plug connector to the holder in a pre-assembly position. The connector position assurance slide member is movable between an open position and a closed position. The connector position assurance slide member is only capable of moving from the open position to the closed position when the plug connector is correctly attached to the holder.

DETAILED DESCRIPTION OF THE INVENTION

Figure 1:
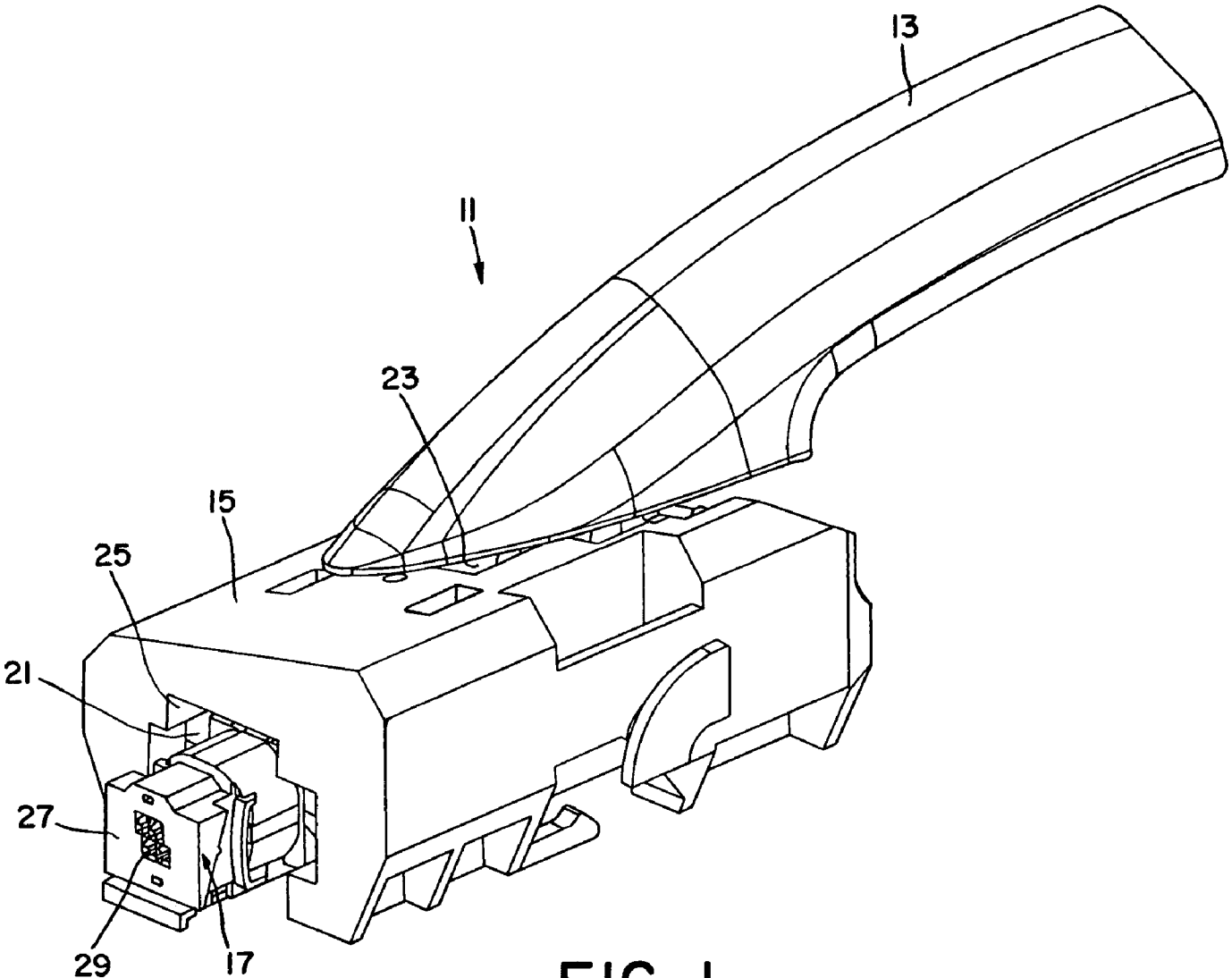
FIG. 1 is a perspective view of an electrical plug connection system.
Figure 4:
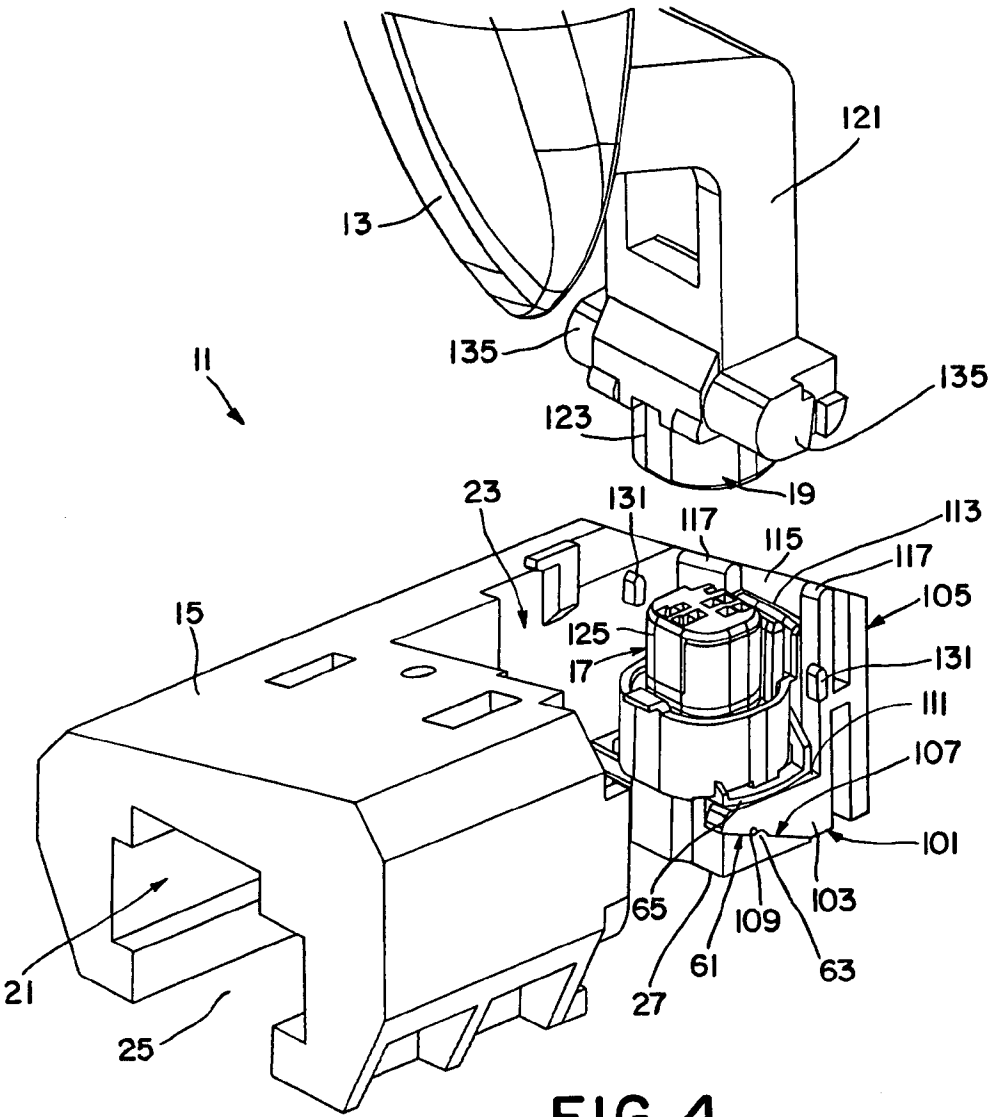
FIG. 4 is an exploded view of the plug connection system in a first assembly position, wherein the plug connector is positioned in a holder of a bearing shell and a plug connection member of a door handle is not yet engaged with the plug connector.

FIG. 1 shows an electrical plug connection system 11. The electrical plug connection system 11 has a door handle 13, which is only illustrated in part, a bearing shell 15 and a plug connector 17. The door handle 13 has a plug connection member 19, as shown in FIG. 4. The bearing shell 15 is provided for assembly in an internal region of a vehicle door (not shown), for example within door-mounted equipment or within a vehicle door lining, and has a longitudinal axis that extends in substantially the same direction as a longitudinal axis of the door handle 13, as shown in FIG. 1. The bearing shell 15 has a passageway 21 that has an open end 25. The passageway 21 extends in a direction of the longitudinal axis of the bearing shell 15 and is closed on an upper side. As best shown in FIG. 4, the bearing shell has an opening 23 that extends perpendicular to the longitudinal axis of the bearing shell 15 and perpendicular to the longitudinal axis of the passageway 21.

As shown in FIG. 1, the plug connector 17 projects somewhat from the open end 25 of the passageway 21 and is positioned remote from the opening 23 in a final assembly position. The plug connector 17 has a cable terminal end 27 with cable receiving openings 29 that receive electrical cables (not shown) to which plug contact elements (not shown), for example socket contacts, accommodated in the plug connector 17 are attached. The electrical cables (not shown) are connected to electronic components (not shown) inside the vehicle door (not shown), for example inside the door-mounted equipment or the vehicle door lining, to electrically connect the plug connector 17 to the electronic components (not shown).

Alternatively, the cable receiving openings 29 on the cable terminal end 27 of the plug connector 17 may be formed as insertion openings for pin contacts (not shown) attached to ends of the electrical cables (not shown) leading from the electronic components (not shown) inside the vehicle door (not shown). The pin contacts (not shown) may be brought into plug connection with socket regions of pin contact elements (not shown) accommodated in the plug connector 17. The pin contact elements (not shown) of the plug connector 17 are constructed at both ends as socket contacts so that the pin contacts (not shown) attached to the electrical cables (not shown) can be received at one end and pin contacts (not shown) of the plug connection member 19 can be received at the other end.

Figure 2:
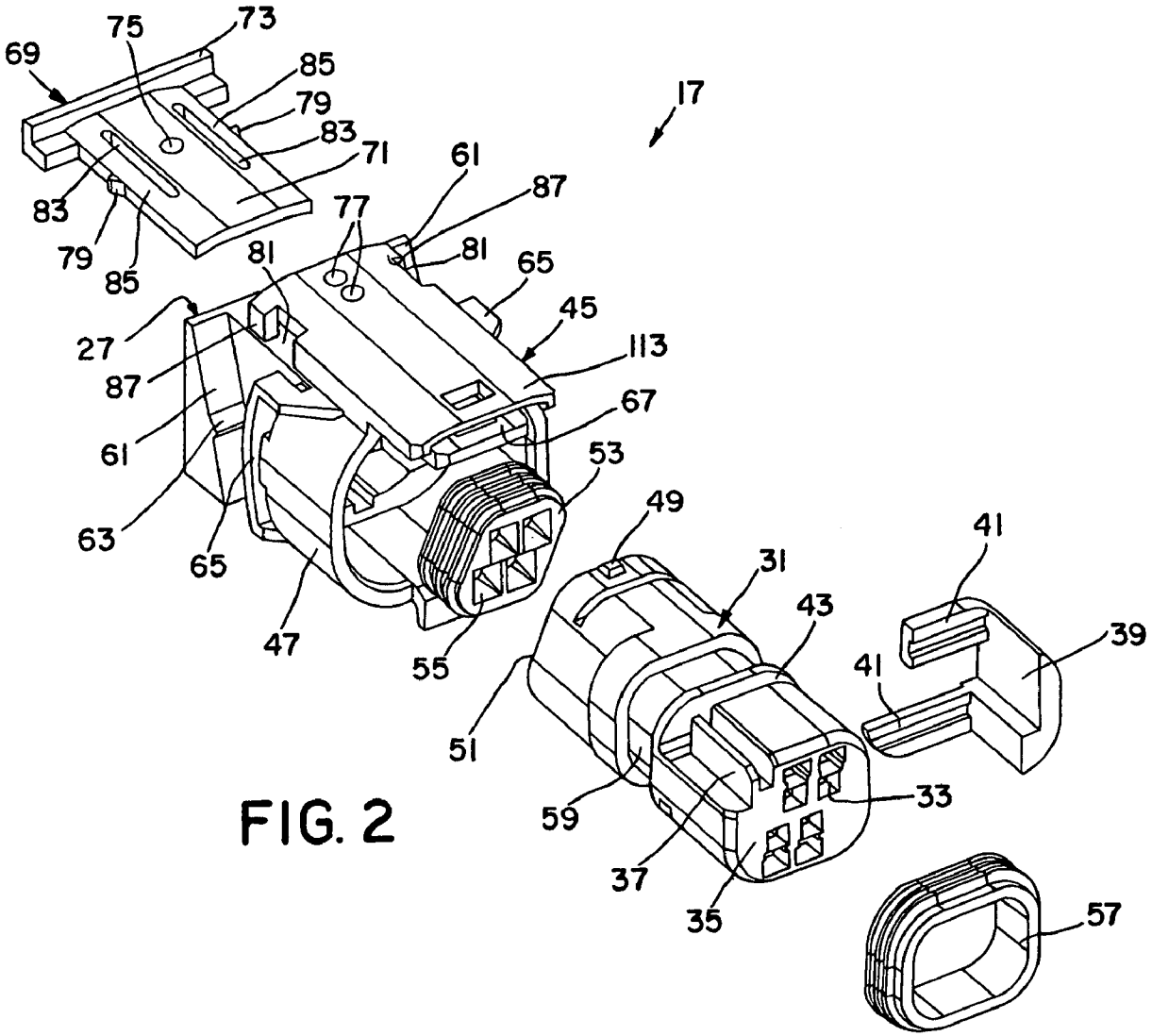
FIG. 2 is an exploded view of a plug connector.

As shown in FIG. 2, the plug connector 17 includes a connector housing 31. The connector housing 31 is made from an insulative material and has a first end face 35 and a second end face 51. The connector housing 31 is provided with contact receiving chambers, which each have insertion openings 33 for receiving the plug contact elements (not shown). In the illustrated embodiment, the connector housing 31 is designed as a four-pin plug connector which may be brought into plug connection with four plug contact elements (not shown) of the plug connection member 19 of the door handle 13. Alternatively, the plug connection member 19 may have only two plug contact elements (not shown), and only two electrical cables (not shown) may be fed out through the cable terminal end 27 of the plug connector 17. A four-pin variant on the plug connector 17 is used, for example, for the door locks on front doors of the vehicle, and a two-pin variant on the plug connector 17 is used, for example, for the door locks on rear doors of the vehicle. The connector housing 31 has a coding element 37. In FIG. 2, for example, the coding element 37 is constructed as a radial coding web that fits into a complementary coding recess (not shown) in a housing of the plug connection member 19. The coding element 37 differs in shape and/or position in dependence on whether the plug connector 17 is constructed as the two-pin variant or the four-pin variant so that a two-pin plug connection member 19 cannot be plugged into a four-pin plug connector 17 or vice versa.

As shown in FIG. 2, the plug connector 17 includes a secondary locking element 39. The secondary locking element 39 has two radial locking arms 41. Each of the locking arms 41 corresponds to a locking opening 43 in the connector housing 31. The locking arms 41 reach in a known manner behind shoulders of the contact elements (not shown) accommodated in the connector housing 31 to secure the contact elements (not shown) in the correct axial position. A radial seal 57 is mounted on a seat 59 of the connector housing 31. The radial seal 57 forms a seal between the plug connector 17 and the plug connection member 19 of the door handle 13 when the plug connector 17 is in plug connection therewith.

The plug connector 17 includes an outside housing 45. A front region of the outside housing 45 is constructed as a tubular member 47. The tubular member 47 has an internal shape complementary to an external shape of a rear region of the connector housing 31 so that the tubular member 47 can receive the latter substantially with form fit. The connector housing 31 and the outside housing 45 may be secured to one another by a latching projection 49 on the connector housing 31 cooperating with a complementary recess on an inside of the outside housing 45.

Between the second end face 51 of the connector housing 31 and an inner end face of the outside housing 45 is a first seal 53. The first seal 53 has seal openings 55. Each of the seal openings 55 receives one of the electrical cables (not shown). The first seal 53 creates a fluid-tight or at least water-tight seal between the electrical cables (not shown) and the first seal 53 and between the inside of the outside housing 45 and the second end face 51 of the connector housing 31. To further avoid moisture from penetrating into the plug connector 17 when the plug connector 17 is used in the two-pin variant, the outside housing 45 is provided with sealing pins (not shown). The sealing pins (not shown) project inward from the inside of an end wall of the outside housing 45 on the cable terminal side, extend through the seal openings 55 that do not have the electrical cables (not shown), and cooperate with the first seal 53 in a sealing manner.

On both sides of an end region adjacent to the cable terminal end 27, the outside housing 45 has oblique shoulders 61. Each of the shoulders 61 has an inclined latching projection 63 formed approximately in a longitudinal center of the shoulder 61. The latching projection 63 is inclined such that a lower end of the latching projection 63 is closer to the tubular member 47 than an upper end. Opposite each of the shoulders 61 and having a predetermined spacing therefrom are spring elements 65. Each of the spring elements 65 are formed as spring brackets and are precurved in a relaxed state such that the spring element 65 is concave with respect to the respective shoulder 61 and can be pressed with spring resilience in opposition to its spring force in a direction away from the respective shoulder 61.

As shown in FIG. 2, a top surface 113 of the outside housing 45 defines a receiving channel 67 for a connector position assurance slide member 69. The connector position assurance slide member 69 is arranged along an axial direction of the outside housing 45 on an upper side thereof. The connector position assurance slide member 69 includes a plate 71 that fits into the receiving channel 67. An angled web 73 projects from both sides beyond a width of the plate 71 and forms a region for gripping the connector position assurance slide member 69 so that the connector position assurance slide member 69 can be easily slid into the receiving channel 67. The angled web 73 also serves a locking function, which will be explained in more detail below.

An upper side of the plate 71 is provided with a latching protrusion 75. The latching protrusion 75 is in the shape of a partial sphere and is formed to be brought into latching connection with either a first or second latching recess 77 on the outside housing 45. The first and second latching recesses 77 are arranged one behind the other in the axial direction of the outside housing 45. Depending on whether the latching protrusion 75 is latched into the first latching recess 77 or the second latching recess 77, the connector position assurance slide member 69 is in an open position (first latching recess 77) or a closed position (second latching recess 77). It is only possible to bring the connector position assurance slide member 69 into the closed position if the plug connector 17 is correctly held in the pre-assembly position, as will be explained below.

Latch members 79 are formed on longitudinal sides of the plate 71. The latch members 79 engage in corresponding recesses 81 on the longitudinal sides of the receiving channel 67 from the inside of the receiving channel 67. Between the latching protrusion 75 and each of the latch members 79 is a longitudinal slot 83. The longitudinal slot 83 extends over a length of the plate 71 such that there is formed between the respective longitudinal slot 83 and the respective latch member 79 a spring web 85. The spring web 85 makes it possible for the respective latch members 79 to yield inward when the connector position assurance slide member 69 is slid into the receiving channel 67. The latch members 79 overcome the web projections 87, and the plate 71 is advanced into the receiving channel 67 until the web members 79 reach the recesses 81 where the spring webs 85 can return to a relaxed state. The axial length of the recess 81 is selected such that the latch members 79 can move inside the recesses 81 when the connector position assurance slide member 69 is displaced between the open position and the closed position.

Figure 3:
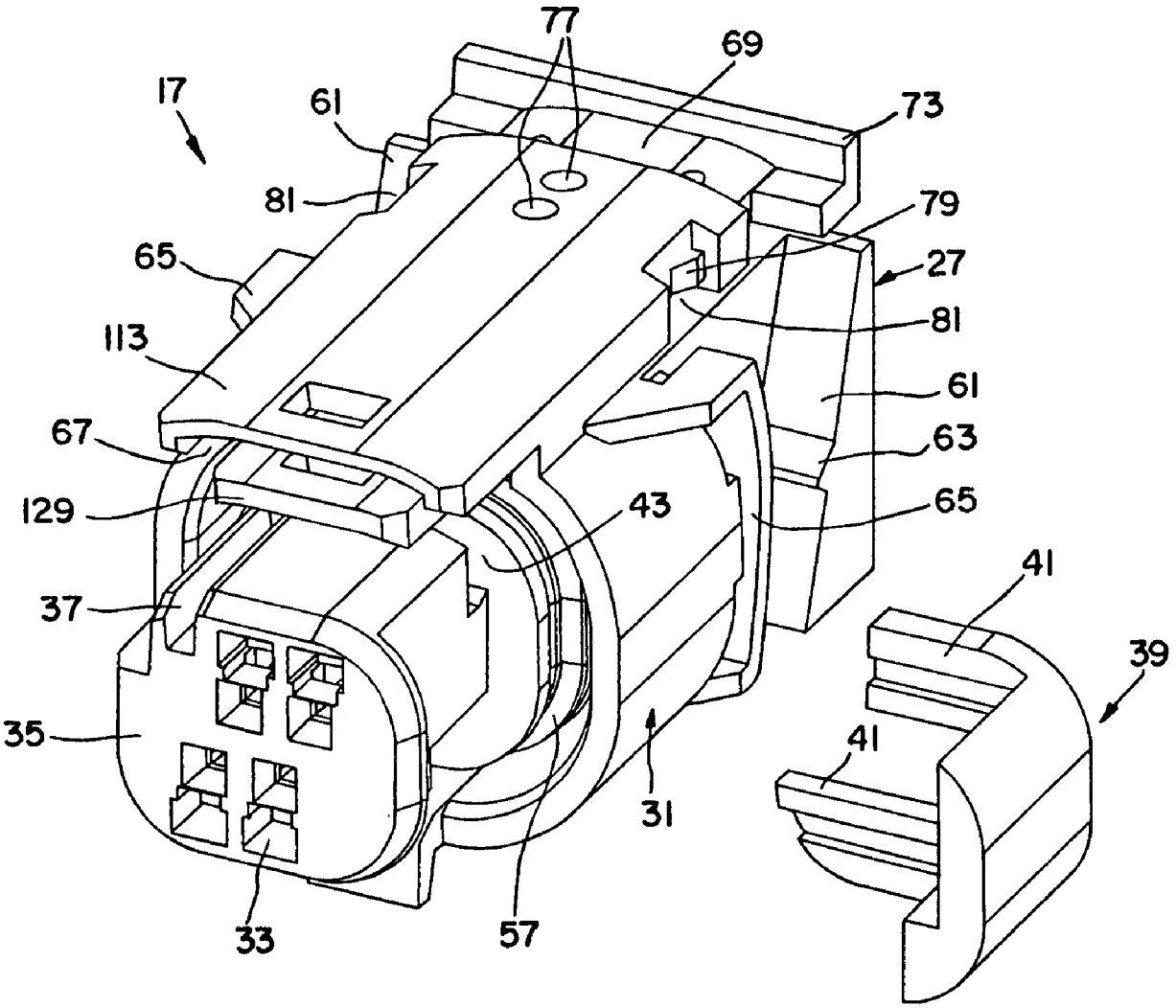
FIG. 3 is a partially exploded perspective view of the plug connector in a delivery state.

FIG. 3 shows the plug connector 17 in the state in which it is delivered by the manufacturer. With the exception of the secondary locking element 39, all of the elements of the plug connector 17 are assembled and the connector position assurance slide member 69 is in the open position. In the open position, the latching protrusion 75 is latched into the first latching recess 77. The latch members 79 abut against an end of the recess 81 and the angled web 73 is spaced from an end of the receiving channel 67.

Figure 7:
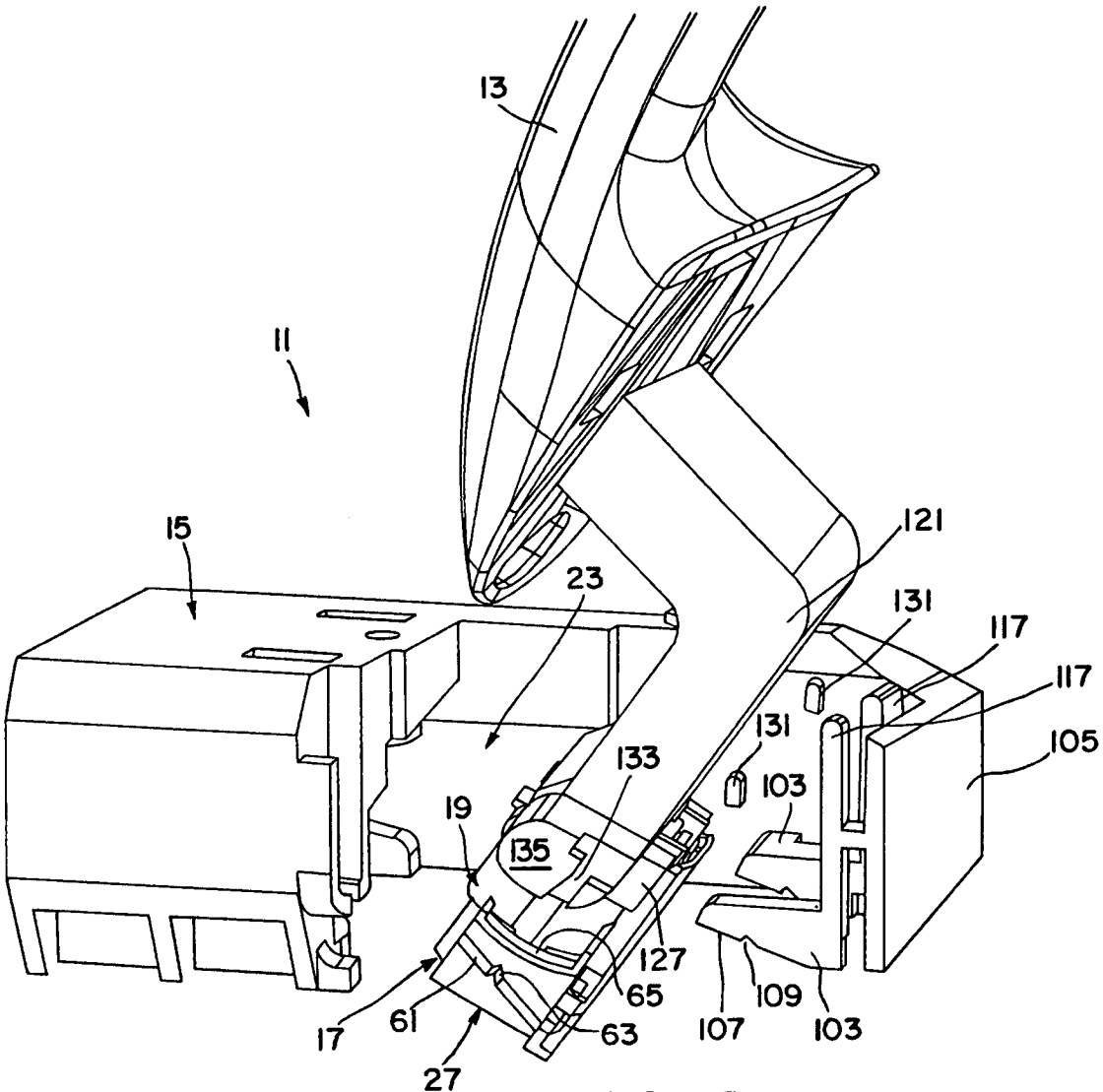
FIG. 7 is a perspective view of the electrical plug connection system in a fourth assembly position, wherein the plug connector has been pivoted out of the holder but has not yet been pivoted into a final assembly position.

Assembly of the electrical plug connection system 11 shown in FIG. 1 will now be explained in greater detail. As shown in FIG. 4, the plug connector 17 is put into a pre-assembly position in a holder 101 of the bearing shell 15. The holder 101 has holding arms 103 that extend from a holding wall 105 of the opening 23 into the internal region of the opening 23 in a direction parallel to the longitudinal axis of the passageway 21, as best shown in FIG. 7. The holding arms 103 are spaced from one another such that abutment faces 107 formed on lower sides thereof lie on the respective shoulders 61 of the outside housing 45, as shown in FIG. 4. The abutment faces 107 have an angle of inclination formed to correspond to the shoulders 61 and cutouts 109 formed to correspond to the latching projections 63 of the plug connector 17. The holding arms 103 extend such that bearing faces 111, which are formed on upper sides of the holding arms 103, run substantially parallel to the longitudinal axis of the passageway 21. The bearing faces 111 resiliently pretension the spring elements 65 so that the spring elements 65 exert a spring force that secures the connection between the latching projection 63 and the cutouts 109 thereby preventing the plug connector 17 from slipping out of the holder 101. When the plug connector 17 is in this position, the spring elements 65 still have a precurved shape so that it is possible for the spring elements 65 to undergo further resilient yielding.

Figure 8:
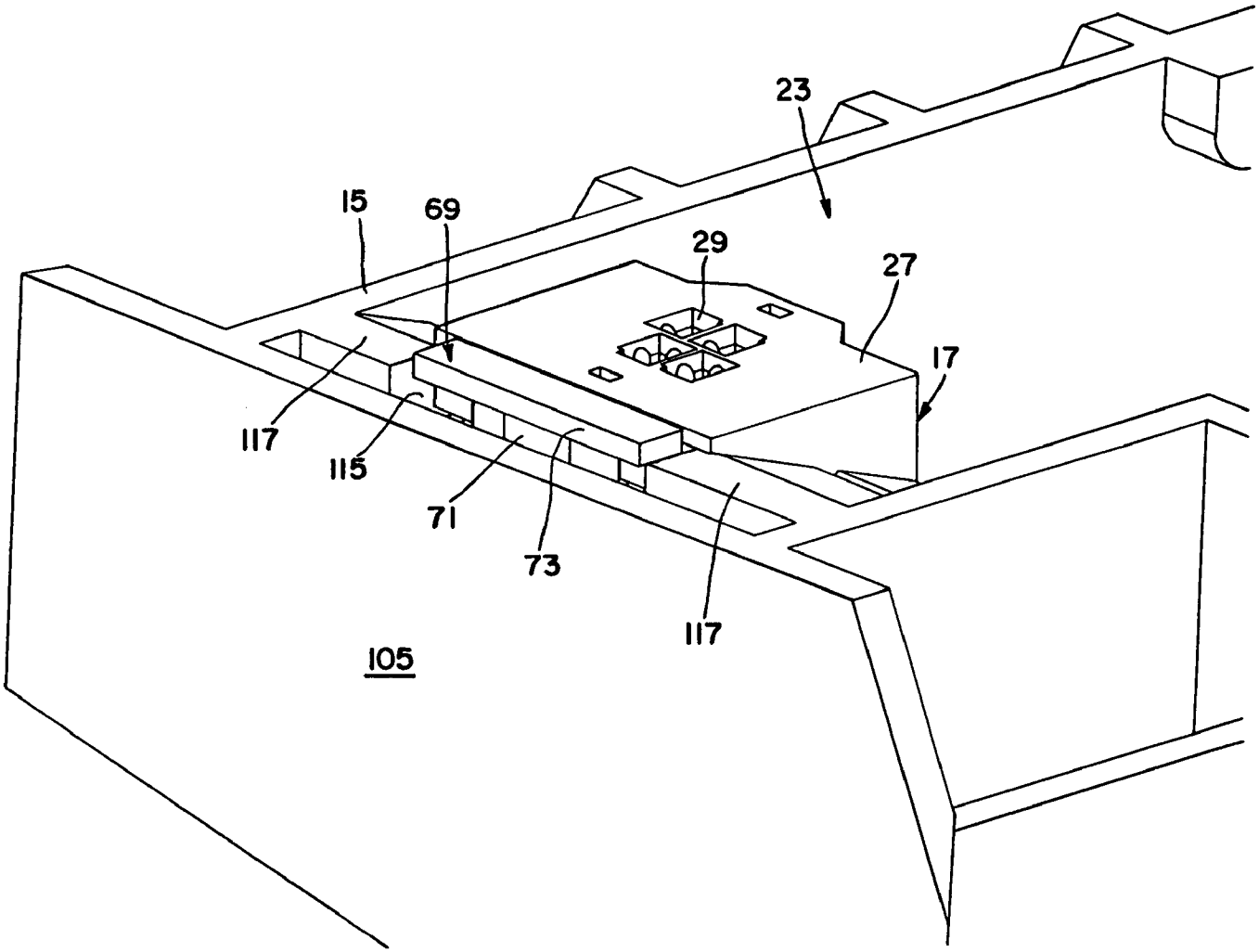
FIG. 8 is a perspective view of the electrical plug connection system shown in FIG. 4, as seen from below, wherein the plug connector is located in a pre-assembly position and a connector position assurance slide member on the plug connector is in a closed position.
Figure 9:
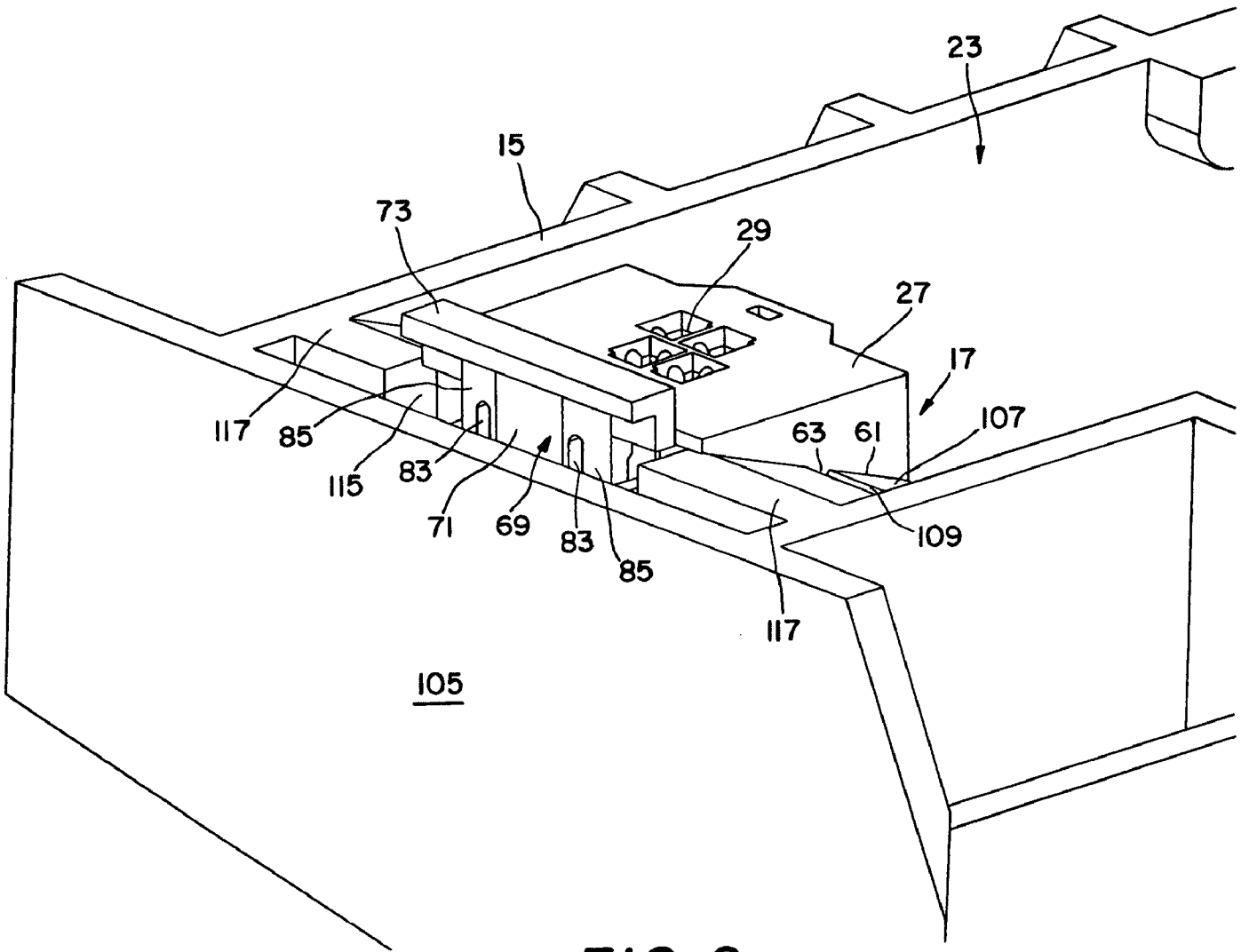
FIG. 9 is a perspective view of the electrical plug connection system shown in FIG. 8, wherein the connector position assurance slide member is in an open position.
Figure 10:
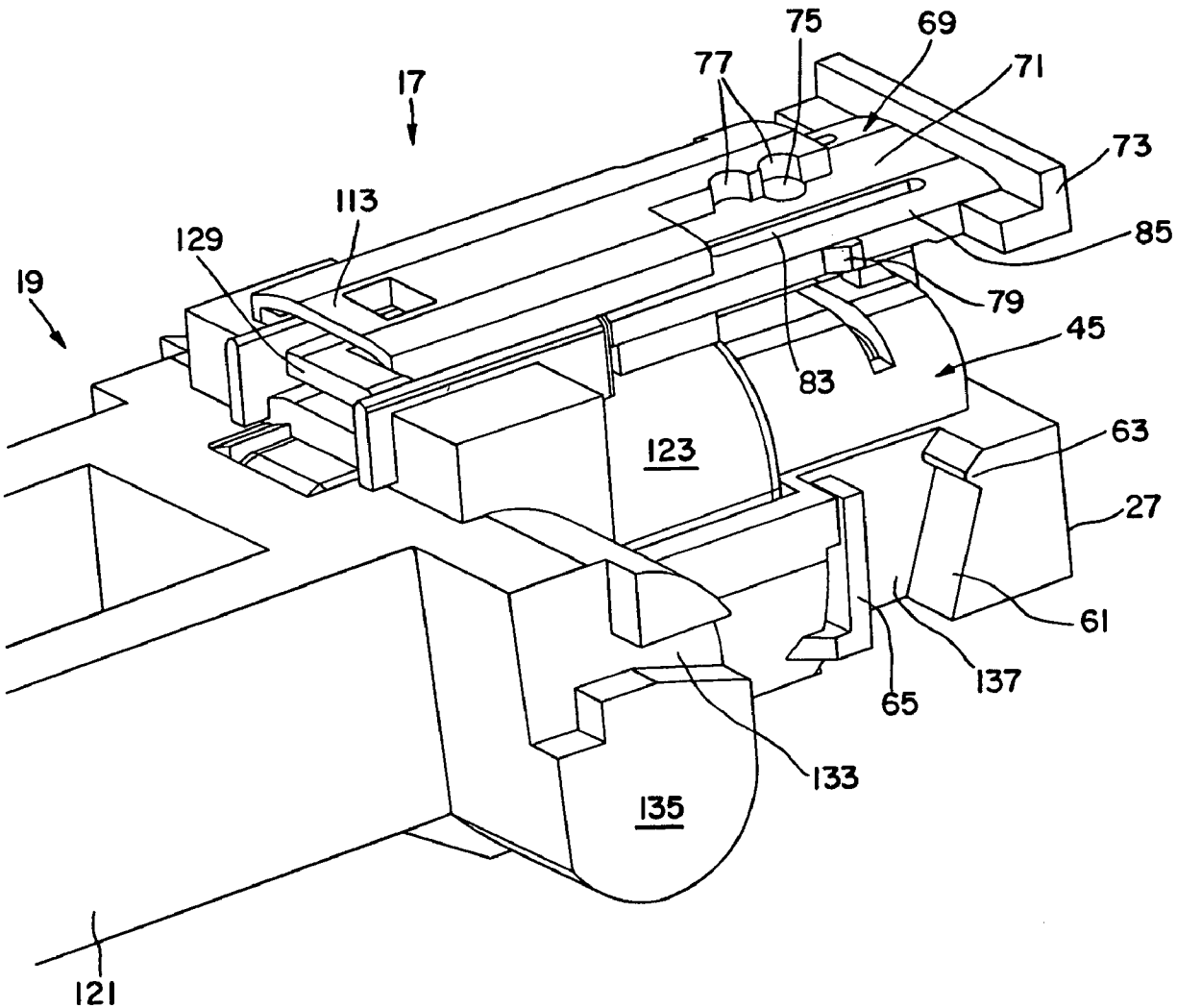
FIG. 10 is a perspective view of the plug connector and part of the plug connection member of the door handle in plug connection therewith, wherein the bearing shell is missing.
Figure 11:
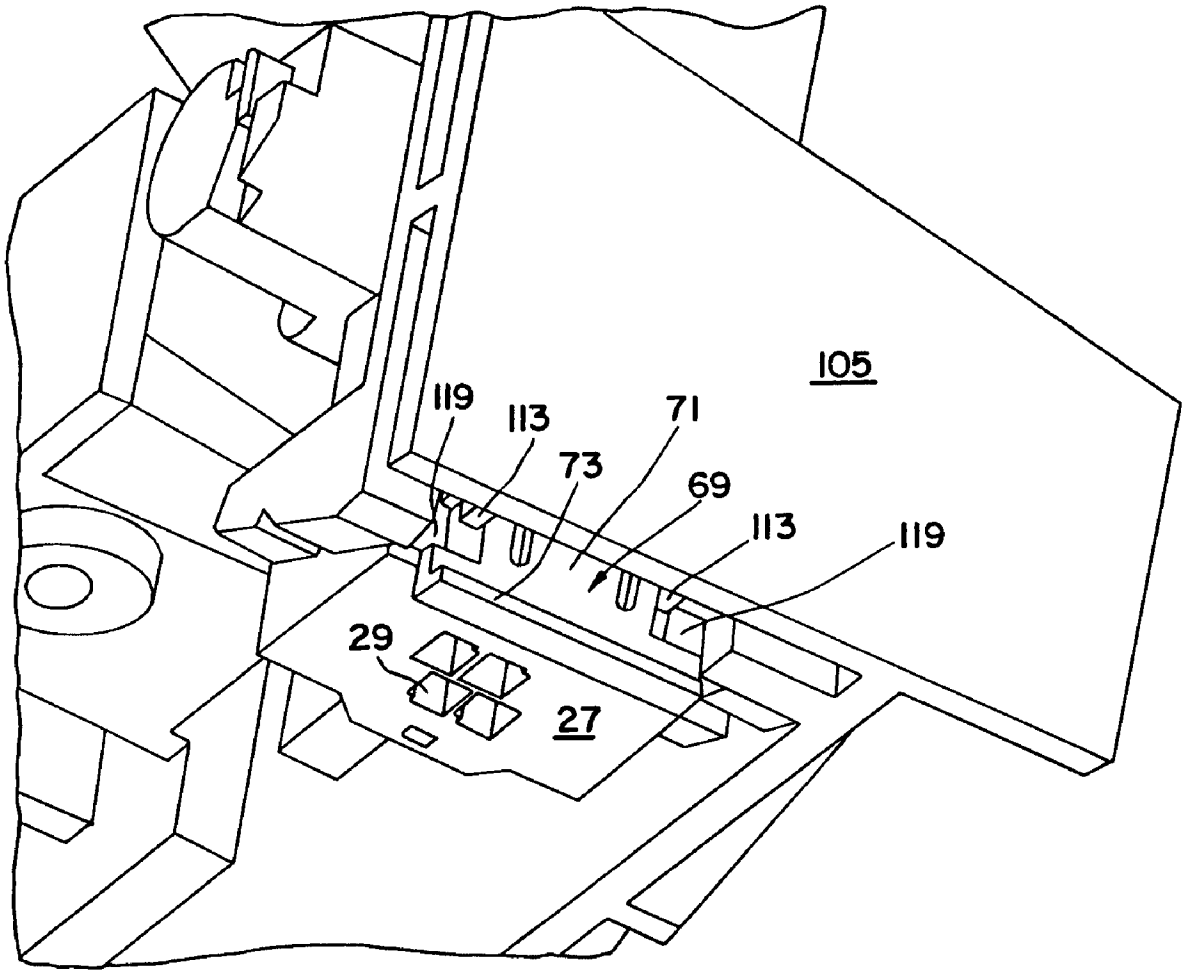
FIG. 11 is a perspective view of the connector position assurance slide member.

When the plug connector 17 is in the correct pre-assembly position, the top surface 113 of the outside housing 45, which closes off the receiving channel 67, projects into a channel 115 formed between holding wall webs 117 in the holding wall 105. As best shown in FIG. 11, the top surface 113 abuts against the inside of the holding wall 105. Locking faces 119 are formed in a region of the holding wall webs 117. Side ends of the angled web 73, which project laterally beyond the plate 71 of the connector position assurance slide member 69, reach over the locking faces 119 when the connector position assurance slide member 69 is moved from the open position, as shown in FIGS. 9 and 11, into the closed position, as shown in FIG. 8. Because the end regions of the angled web 73 abut the locking faces 119, the plug connector 17 cannot be taken out of its pre-assembly position while the connector position assurance slide member 69 is in the closed position. Since the plug connector 17 is locked in the holder 101 in the pre-assembly position by means of the connector position assurance slide member 69, the plug connector 17 cannot unintentionally fall out of the holder 101 of the bearing shell 15. A structural unit including the bearing shell 15 and the plug connector 17 in the pre-assembly position can thus readily be handled for the purpose of assembly without the plug connector 17 coming out of the pre-assembly position.

The locking faces 119 are spaced from the inside of the holding wall 105 and are dimensioned such that there is only enough spacing between the inside of the holding wall 105 and the locking faces 119 for the connector position assurance slide member 69 to be capable of being pushed into the closed position when the plug connector 17 is in the correct pre-assembly position. Resultantly, until the plug connector 17 is put into the correct pre-assembly position, the connector position assurance slide member 69 cannot be moved from the open position into the closed position. It is therefore simple to check whether the plug connector 17 is in the correct pre-assembly position by reaching under the plug connector 17, positioned in accordance with FIG. 4, and manually trying to press the connector position assurance slide member 69 from the open position into the closed position. If this is unsuccessful, the plug connector 17 is not in the correct pre-assembly position. If it successful, then the plug connector 17 is in the correct pre-assembly position.

Once the structural unit including the bearing shell 15 and the plug connector 17 is in the pre-assembly position and is assembled in a vehicle door, the door handle 13, which is connected by an angled supporting member 121 to the plug connection member 19, is positioned above the first end face 35 of the plug connector 17, as shown in FIG. 4. The door handle 13 is lowered so that the plug connection member 19 comes into plug connection with the plug connector 17. A collar 123 that projects from an end face of the plug connection member 19 in a direction of the plug connector 17 reaches around an axial member 125 that projects out of the outside housing 45 of the plug connector 17 and engages the radial seal 57 of the plug connector 17, as shown in FIG. 5.

When the connector position assurance slide member 69 is in the closed position, the slide member end face 129 projects out of the end of the receiving channel 67 and can be gripped by an ejector projection 127 on the plug connection member 19. Moving the door handle 13 further toward the plug connector 17 once the ejector projection 127 has been placed on the slide member end face 129 presses the connector position assurance slide member 69 out of the closed position and into the open position to release the angled web 73 and the locking faces 119 so that the plug connector 17 is no longer held firmly against the holding wall 105.

Figure 5:
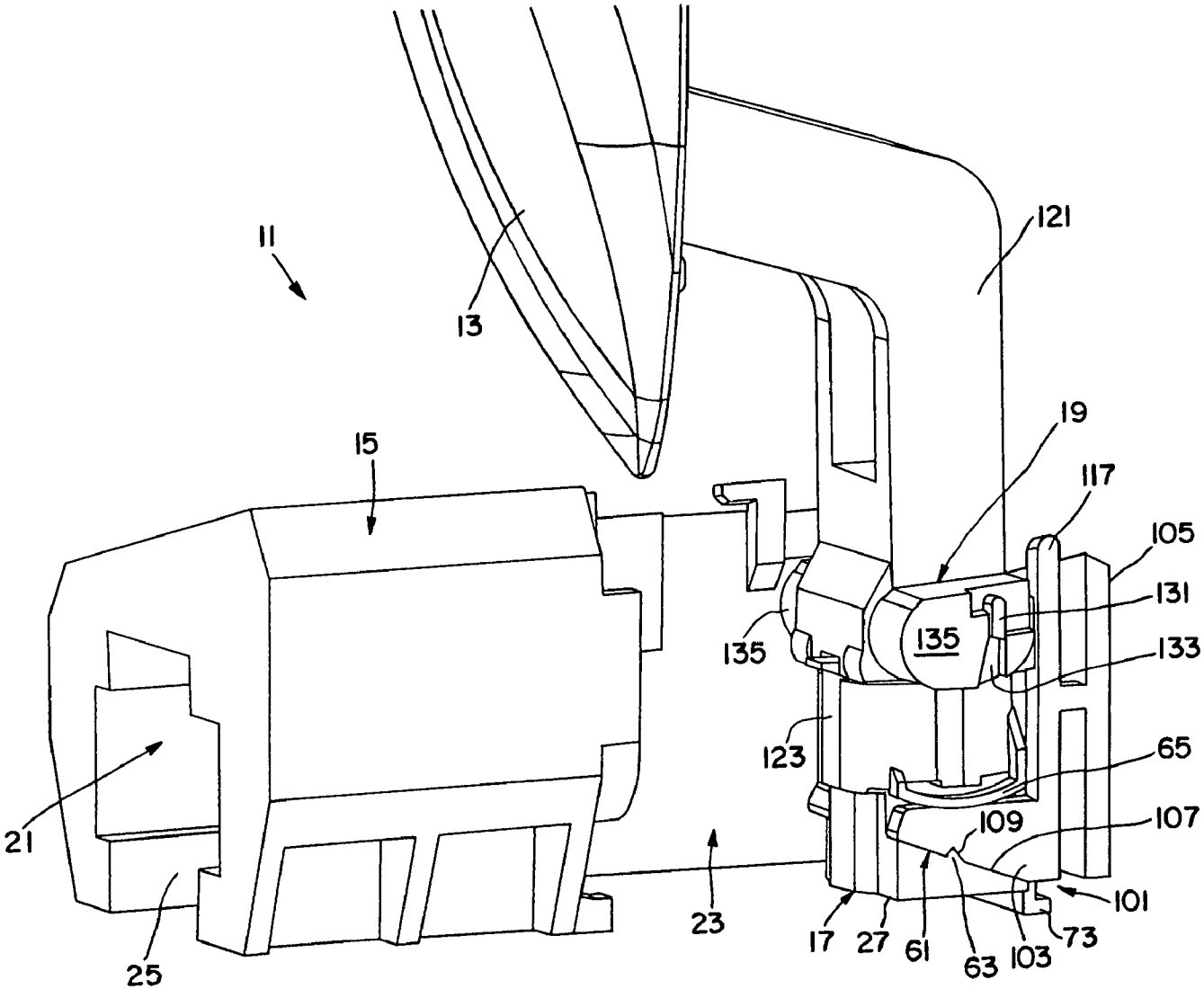
FIG. 5 is a perspective view of the electrical plug connection system in a second assembly position, wherein the plug connection member of the door handle has already been brought into plug connection with the plug connector, although the plug connector has not been released from the holder.
Figure 6:
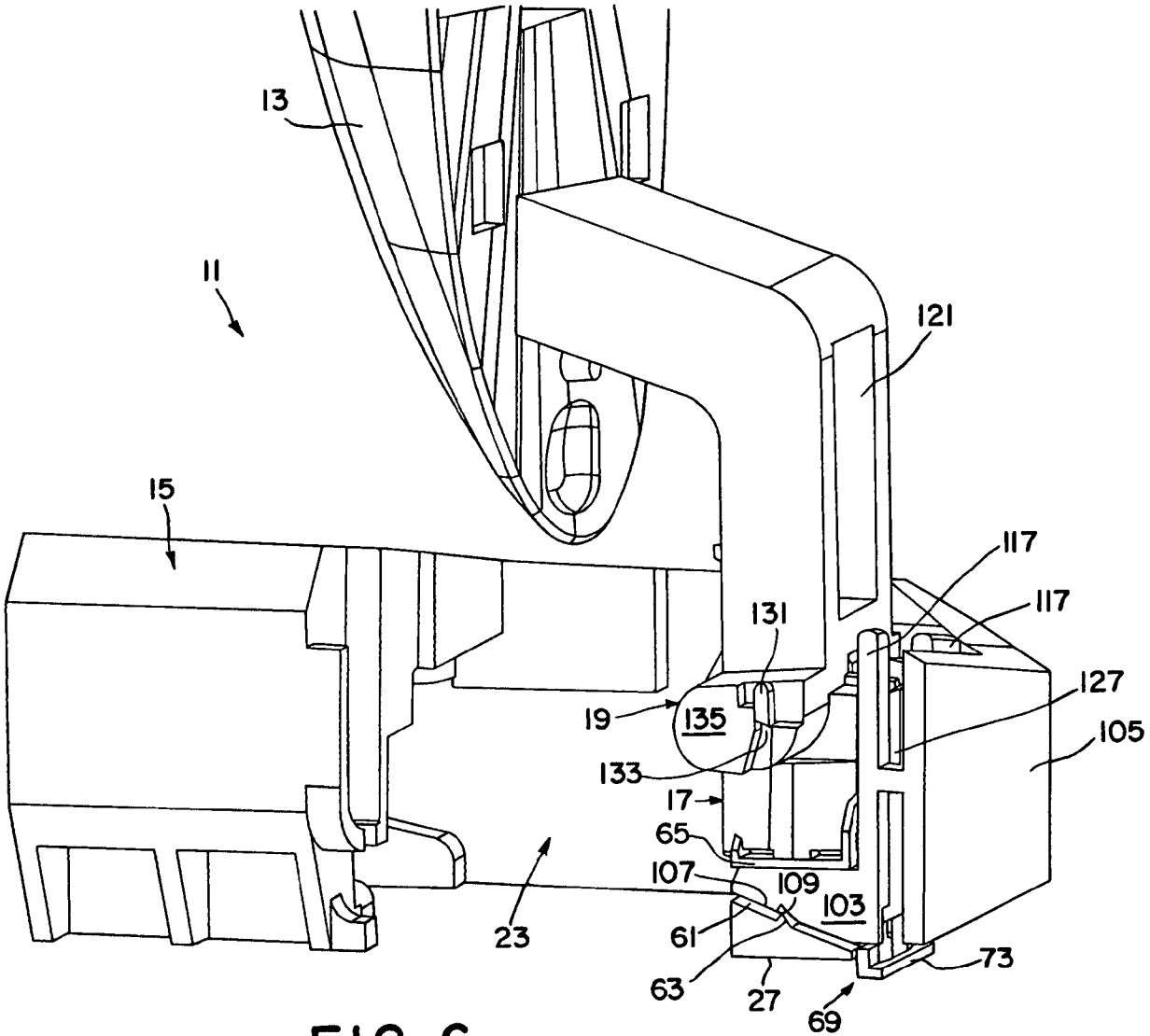
FIG. 6 is a perspective view of the electrical plug connection system in a third assembly position, wherein the plug connector has already been released from the holder.

If from the position shown in FIG. 5, the door handle 13 is pressed further in the direction of the plug connector 17, the spring force of the spring element 65 is overcome and the plug connector 17 is moved into the assembly position shown in FIG. 6. In the assembly position, the shoulders 61 of the plug connector 17 are moved away from the abutment faces 107 to release the latching projections 63 from the cutouts 109. The door handle 13 then pivoted, together with the plug connection arrangement comprising the plug connector 17 and the plug connection member 19, into the position shown in FIG. 7. Once the door handle 13 and the plug connection arrangement reaches the position shown in FIG. 7, the door handle 13 and the plug connection arrangement is pivoted to a final position wherein the longitudinal axis of the plug connection arrangement is in alignment with the longitudinal axis of the passageway 21, as shown in FIG. 1.

A guide assembly prevents the door handle 13 from pivoting into the position in FIG. 7 until the position in FIG. 6 is achieved. The guide assembly includes a guide web 131, as shown in FIG. 4, arranged on a longitudinal side wall of the bearing shell 15 in the region of the opening 23 and guide grooves 133, as shown in FIG. 7, formed in side portions 135 on either side of the plug connection member 19. As shown in FIG. 5, the guide groves 133 prevent the door handle 13 from pivoting until the guide webs 131 have come out of the upper ends (as seen in FIG. 6) of the guide grooves 133.

Because the open end 25 of the passageway 21 is no longer accessible once the bearing shell 15 has been mounted in a final position within the door-mounted equipment (not shown) and the door lining (not shown) has been closed off, it is not possible to introduce the plug connector 17 through the open end 25 into the passageway 21 of the bearing shell 15 or to put the electrical cables (not shown) or the plug contacts (not shown) for the contact elements plug (not shown) of the plug connector 17 through the cable receiving openings 29 in the plug connector 17. For this reason, the electrical plug connection system 11 positions the plug connector 17 in the opening 23 in the bearing shell 15 in a pre-assembly position in the manner shown in FIG. 4, with the plug connector 17 already connected to the electrical cables (not shown), which are fed out of the cable terminal end 27, before the bearing shell 15 is mounted in the door-mounted equipment (not shown). By pivoting the door handle 13, a plug connection between the plug connection member 19 of the door handle 13 and the plug connector 17, which is temporarily locked in the bearing shell 15 in the pre-assembly position, can thereby easily and efficiently be made.

The invention claimed is:

1. An electrical plug connection system, comprising:

a vehicle door handle having a plug connection member;

a bearing shell for positioning in a vehicle door having a passageway and an opening, the opening communicates with the passageway and receives the plug connection member;

a holder arranged in the bearing shell adjacent to the opening;

a plug connector attached to the holder in a pre-assembly position, the plug connector positioned substantially perpendicular to the passageway in the pre-assembly position, the plug connector being releasable from the holder when the plug connection member engages the plug connector, the plug connector being pivotable into the passageway by the plug connection member after the plug connector is released to a final position, the plug connector positioned substantially parallel to the passageway in the final position; and the holder includes at least one holding arm that extends into the passageway and receives the plug connector, the plug connector including a shoulder and a spring element that receives the holding arm therebetween to secure the plug connector to the holder with a spring force.

2. The system of claim 1, wherein the opening extends perpendicular to the passageway.

3. The system of claim 1, wherein the shoulder has a latching projection that engages with a cutout on the holding arm.

4. The system of claim 1, wherein the plug connection member overcomes the spring force of the spring element to release the plug connector from the holder.

5. The system of claim 1, wherein the plug connector is positioned in the passageway remote from the opening in the final position.

6. An electrical plug connection system, comprising:

a vehicle door handle having a plug connection member;

a bearing shell for positioning in a vehicle door having a passageway and an opening, the opening communicates with the passageway and receives the plug connection member;

a holder arranged in the bearing shell adjacent to the opening;

a plug connector attached to the holder in a pre-assembly position, the plug connector positioned substantially perpendicular to the passageway in the pre-assembly position, the plug connector being releasable from the holder when the plug connection member engages the plug connector, the plug connector being pivotable into the passageway by the plug connection member after the plug connector is released to a final position, the plug connector positioned substantially parallel to the passageway in the final position; and the plug connector including a connector position assurance slide member that secures the plug connector to the holder in the pre-assembly position, the plug connection member having an ejector projection that engages the connector position assurance slide member to move the connector position assurance slide member from the closed position to the open position to release the plug connector from the holder.

7. The system of claim 6, wherein the connector position assurance slide member moves between an open position and a closed position, the connector position assurance slide member only being capable of moving from the open position to the closed position when the plug connector is correctly attached to the holder.

8. An electrical plug connection system, comprising:

a vehicle door handle having a plug connection member;

a bearing shell for positioning in a vehicle door having a passageway and an opening, the opening communicates with the passageway and receives the plug connection member;

a holder arranged in the bearing shell adjacent to the opening; and a plug connector having a connector position assurance slide member that secures the plug connector to the holder in a pre-assembly position, the plug connection member having an ejector projection that engages the connector position assurance slide member to release the plug connector from the holder, the plug connector being pivotable into the passageway by the plug connection member after the plug connector is released to a final position.

9. The system of claim 8, wherein the connector position assurance slide member moves between an open position and a closed position, the connector position assurance slide member only being capable of moving from the open position to the closed position when the plug connector is correctly attached to the holder.

10. The system of claim 8, wherein the plug connector is positioned in the passageway remote from the opening in the final position.

11. The system of claim 8, wherein the opening extends perpendicular to the passageway.

12. The system of claim 11, wherein the holder includes at least one holding arm that extends into the passageway and receives the plug connector.

13. The system of claim 12, wherein the plug connector includes a shoulder and a spring element that receives the holding arm therebetween to secure the plug connector to the holder with a spring force.

14. The system of claim 13, wherein the shoulder has a latching projection that engages with a cutout on the holding arm.

15. The system of claim 13, wherein the plug connection member overcomes the spring force of the spring element to release the plug connector from the holder.

16. An electrical plug connection system, comprising:

a bearing shell for positioning in a vehicle door having a passageway and an opening that communicates with the passageway;

a holder arranged in the bearing shell adjacent to the opening;

a plug connector having a connector position assurance slide member that releasably attaches the plug connector to the holder in a pre-assembly position, the connector position assurance slide member movable between an open position and a closed position, the connector position assurance slide member only being capable of moving from the open position to the closed position when the plug connector is correctly attached to the holder; and the holder including at least one holding arm that extends into the passageway and receives the plug connector, the plug connector having a shoulder and a spring element that receives the holding arm there between to secure the plug connector to the holder with a spring force.

* * * * *

UNITED STATES PATENT AND TRADEMARK OFFICE

CERTIFICATE OF CORRECTION

PATENT NO. : 7,044,744 B2
APPLICATION NO. : 10/911139
DATED : May 16, 2006
INVENTOR(S) : Kai Sellien It is certified that error appears in the above-identified patent and that said Letters Patent is hereby corrected as shown below:

On Title Page, Item (56) Col. 2 under Foreign Patent Documents, "DE 102 35 583 A1" should read --DE 102 32 583 A1--.

On Title Page Item (57) Col. 2 under Abstract, line 6, "bearing shell to the opening" should read --bearing shell adjacent to the opening--.

Signed and Sealed this

Seventh Day of November, 2006

JON W. DUDAS
*Director of the United States Patent and Trademark Office*